United States Patent [19]

Fredman et al.

[11] 4,193,146

[45] Mar. 18, 1980

[54] BUNK BED LADDER BRACKET

[76] Inventors: Harry Fredman; Irving N. Fredman, both of 908 SW. Washington, Peoria, Ill. 61602

[21] Appl. No.: 896,205

[22] Filed: Apr. 13, 1978

[51] Int. Cl.[2] ..... E06C 1/36

[52] U.S. Cl. ..... 5/8; 5/9 B; 182/206; 248/72; 248/214

[58] Field of Search ..... 5/8, 9; 182/106, 206; 248/72, 214, 228, 300

[56] References Cited

U.S. PATENT DOCUMENTS

| | | | |
|---|---|---|---|
| 2,546,556 | 3/1951 | Miller | 298/72 |
| 3,008,534 | 11/1961 | Von Canon, Jr. | 182/206 |
| 3,557,906 | 1/1971 | Gutner | 182/206 |

*Primary Examiner*—Casmir A. Nunberg

*Attorney, Agent, or Firm*—Clarence A. O'Brien; Harvey B. Jacobson

[57] ABSTRACT

A bracket for mounting a bunk bed ladder from the bed rail of an upper bunk bed which engages both the top and inner bottom edge of the bed rail to prevent the bunk bed ladder from being accidentally lifted off and disengaged from the bed rail, to prevent the ladder from shifting along the bed rail, to reduce twisting of the rail and strain on the post or leg of the bunk bed, thereby reducing failure of bed rails, bed posts, and the ladders, and to prevent the ladder from tilting outward while climbing.

10 Claims, 6 Drawing Figures

22
10
14
2
2
18
16
20
24
26
12
24

34
32
16
48
36
52
40
24
50
38
56
30
54
42
44
48
46

64
62
66

16
36
24
70
40
66
60
68
72

84
82
88
86

16
24
92
80
90
94
84

104
102
106

16
24
108
128
110
100
126
130
114
132
112
120
116
118
122
124
108

104
106
36'
108
16'

102
110
128
40'
114
24
112
116
100
126
132
118
130
122
108
124

BUNK BED LADDER BRACKET

BACKGROUND OF THE INVENTION

1. Field of the Invention

The present invention generally relates to bunk beds and more particularly an improved bracket for supporting a bunk bed ladder from the bunk bed assembly in an economical and safe manner.

2. Description of the Prior Art

Bunk bed ladders are now supported from the bed rail of the upper bed of a bunk bed assembly by hooks which merely hook over the upper edge of the upper bed rail. In some instances, each hook is provided with an inwardly offset lower end portion which tends to retain the hook aligned with the bed frame rail even though the ladder may be lifted upwardly. However, there have been many accidents caused by bunk bed ladders being inadvertently lifted off the bed rail or by bunk bed ladders shifting along the bed rail while a child is climbing onto the upper bunk. Another problem which has existed is that when a ladder is suspended solely from the top edge of the bed rail of the upper bunk bed by using conventional hooks and a person climbs up or down the ladder, the weight and pull of the person climbing the ladder introduces a tremendous strain on the bed rail, the ladder and the legs or posts of the bunk bed. Thus, while presently available hooks are relatively simple and inexpensive, they introduce the possibility of injury and a feeling of insecurity due to the looseness of the connection between the ladder and bunk bed.

SUMMARY OF THE INVENTION

An object of the present invention is to provide a bracket for a bunk bed ladder which will secure the ladder to the bed rail of the upper bed in a bunk bed assembly which will prevent the ladder from being lifted off the bed rail and also keep the ladder from shifting longitudinally along the bed rail.

Another object of the invention is to provide a bunk bed ladder bracket in accordance with the preceding object which also prevents twisting or torqueing of the bed rail by forces exerted thereon when climbing the ladder which also reduces the strain on the leg or post of the bed which results from forces exerted by the ladder to the rail and reduces twisting of the rail which further results in less failure of the rails and bed legs or posts.

A further object of the invention is to provide a bracket structure for mounting a ladder on a bunk bed assembly which prevents the ladder from tilting outward when climbing and reduces ladder failure due to forces exerted thereon when climbing the ladder, such as occurs when the ladder is hung from the bed rail by conventional hooks.

Still another important object of this invention is to provide a bracket for a bunk bed ladder capable of being mounted on different standard size bed rails of angular cross-sectional configuration with the bracket including two pieces secured together by a bolt which enables the bracket to be assembled and disassembled in relation to the bed rail while still being interconnected and attached to the ladder, which arrangement also enables preassembly of the brackets onto the ladder so that in order to securely mount the ladder on the bunk bed rail, it is only necessary to tighten two readily accessible bolts, thereby greatly facilitating the assembly of the bunk bed ladder and providing a safe and reliable mounting of the bunk bed ladder on the bunk bed assembly.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
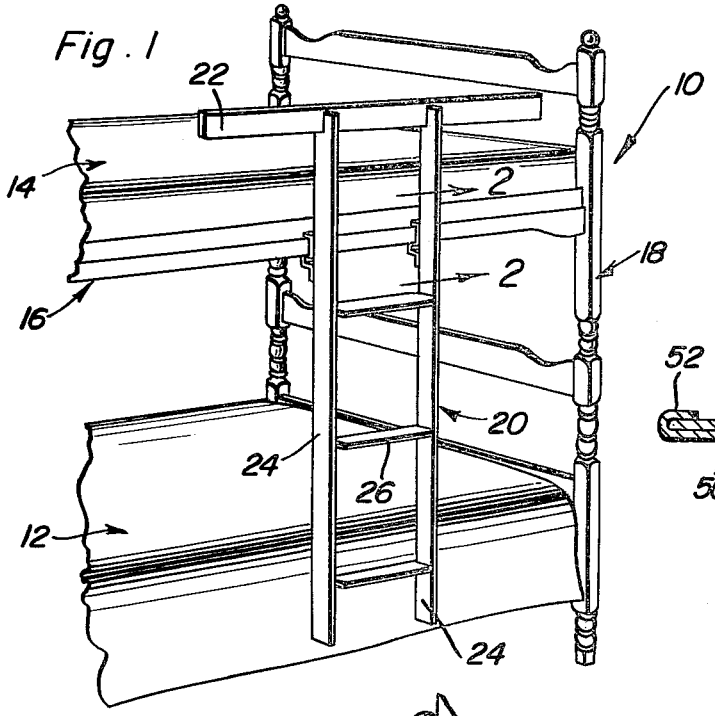
FIG. 1 is a perspective view of a bunk bed assembly illustrating a bunk bed ladder and guard rail associated therewith and secured in place by a bracket of the present invention.

Referring to the drawings, FIG. 1 discloses a portion of a bunk bed assembly 10 including a lower bed 12 and an upper bed 14 supported by longitudinally extending bed rails 16 engaged with legs or posts 18 forming a portion of an end board. A bunk bed ladder generally designated by numeral 20 is supported from the upper bed rail 16 and the upper end of the ladder is usually provided with a longitudinally extending guard rail 22 along the upper surface of the upper bed 14. The ladder 20 includes vertically disposed, parallel stiles 24 interconnected by horizontal, vertically spaced, parallel steps 26. All of the aforementioned structure represents conventional bunk bed construction and the ladder is usually supported from the bed rail 16 by simple hook-type brackets.

Figure 2:
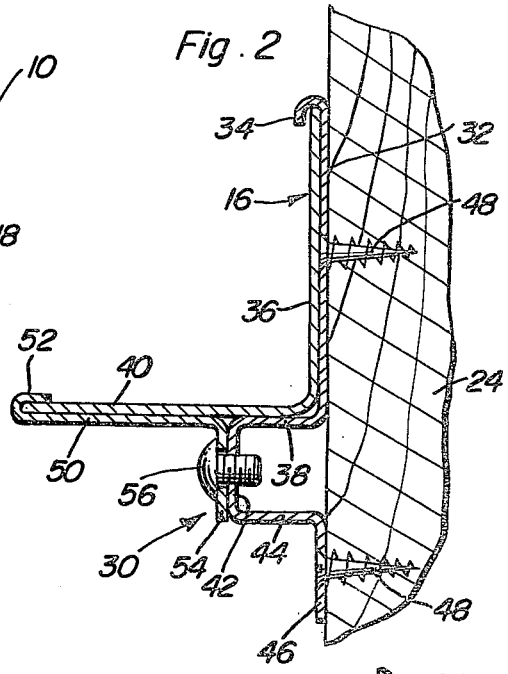
FIG. 2 is a sectional view taken substantially upon a plane passing along section line 2—2 on FIG. 1 illustrating the structure of the ladder bracket and its association with the bed rail and ladder stile.

The present invention is in the form of a bracket connecting each of the stiles 24 of the ladder to the rail 16 with the embodiment of the brackets illustrated in FIGS. 1 and 2 being designated by numeral 30. Each bracket 30 includes a vertical strap or plate 32 of metal or other similar rigid material with the upper end thereof being reversely curved to form a hook 34 engaged with the upper edge of the vertical flange 36 of the bed rail 16 and the lower end of the strap 32 is extended outwardly from the stile 24 as at 38 for underlying the horizontal flange 40 of the bed rail 16. The outer end of the outwardly extending portion 38 turns downwardly into a vertical portion 42 spaced from the stile which terminates at its lower edge in an inwardly extending portion 44 that extends back toward the stile and terminates in a downwardly extending portion 46 disposed against the stile 24 and in alignment with the vertical strap 32. The strap 32 and the lower end portion 46 are attached fixedly to the stile 38 by screw threaded fasteners 48, such as wood screws, which are of conventional construction. The strap 32 is not wider than the thickness of the ladder stiles and preferably slightly narrower and the flat surfaces of the vertical portion 32 and the lower end portion 46 of the strap are disposed flatly against the inner surface of the stile 24. The bracket 30 also includes a securing strap 50 which underlies the horizontal flange 40 and terminates in a reversely bent inner edge or hook 52 which engages the inner edge of the horizontal flange 40. The opposite end of the securing strap 50 is downturned as at 54 and is disposed in parallel relation to the portion 42 of the strap 32. A threaded bolt 56 extends through an aperture in the downturned end 54 and is threaded into an internally threaded aperture in the portion 42 thereby clamping the bracket 30 to the bed rail 16 so that the ladder cannot be disengaged from the bed rail 16 and cannot be slid longitudinally thereon. However, by loosening the bolt 56, the hook-shaped end 52 of the securing strap 50 may be disengaged from the flange 40 thus enabling disengagement of the ladder while leaving the two pieces of the bracket 30 connected, so that when the brackets are assembled on the bed rail 16, it is only necessary to tighten the bolt 56. Thus, the bracket 30 may be preassembled on the stiles 24 with the bolts 56 loosened and after the brackets have been assembled on the rail 16, the bolts 56 simply tightened, thereby facilitating the mounting of the ladder on the bed rails.

Figure 3:
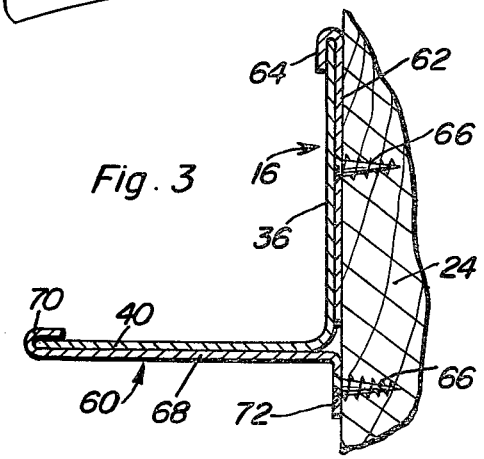
FIG. 3 is a sectional view similar to FIG. 2 but illustrating another embodiment of the bracket.

FIG. 3 illustrates another embodiment of the bracket designated generally by reference numeral 60 which includes a separate vertical strap 62 having a reversely curved hook 64 at its upper end and having a lower end terminating above the bottom of the vertical flange 36 of the bed rail 16, with the strap 62 being secured to the stile 24 by a wood screw 66. The other part of the bracket 60 is in the form of a horizontally disposed anchoring strap 68 having a reversely curved hook 70 at its outer end and a downturned end 72 opposite thereto in alignment with the strap 62 and secured to the stile 24 by a wood screw 66. In this arrangement, the strap 62 is preassembled to the stile and hooked over the top edge of the flange 36 of the bed rail and the strap 68 is then hooked over the inner edge of the flange 40 of the bed rail 16 and secured to the stile by inserting the wood screw 66 through an aperture in the downturned end 72 of the strap 68, thereby securing the ladder to the bed rail 16.

Figure 4:
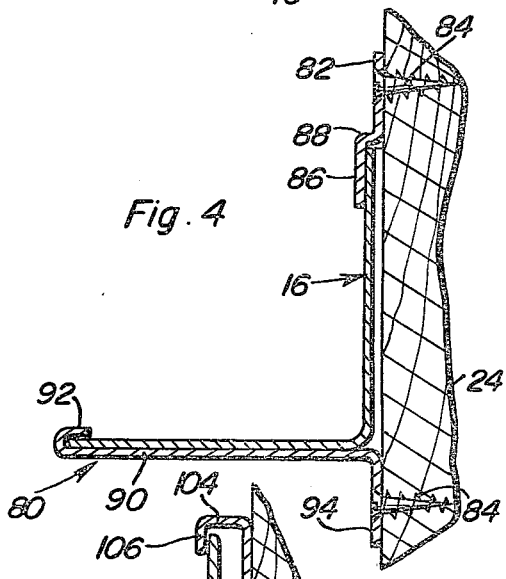
FIG. 4 is a sectional view similar to FIG. 2 illustrating a further embodiment of the bracket.

FIG. 4 illustrates another embodiment of the bracket generally designated by numeral 80 which is provided with a vertical strap 82 disposed above the upper edge of the vertical flange 36 of the bed rail 16 and secured to the stile 24 by a wood screw 84. The lower end 86 of the strap 82 is offset substantially the thickness of the flange 36 by an offset portion 88, thus forming a downwardly opening slot or hook engaged over the top edge of the flange 36. An anchoring strap 90, identical to the anchoring strap 68 in FIG. 3, is associated with the lower flange 40 in exactly the same manner and includes a hook 92 and downturned end 94 secured to the stile 24 in the same manner. Also, the wood screw 84 used to secure the anchoring strap 90 to the stile 24 has to be inserted after the ladder stile has been assembled with the bed rail.

Figure 5:
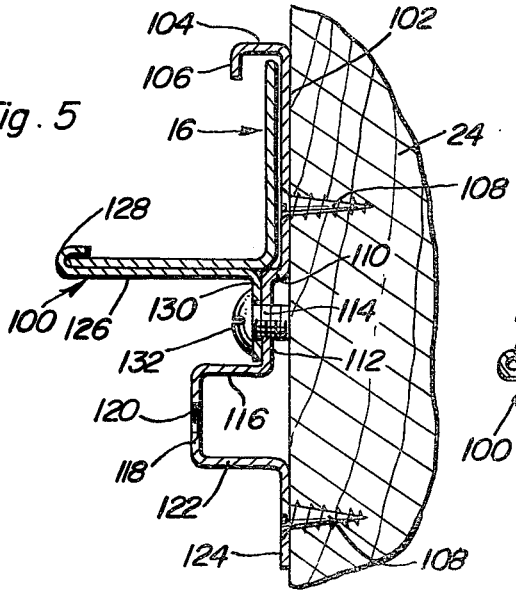
FIG. 5 is a sectional view similar to FIG. 2 illustrating yet another embodiment of the bracket.
Figure 6:
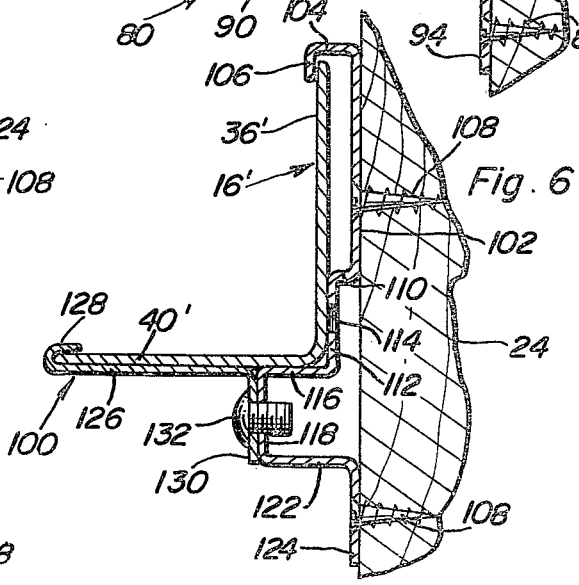
FIG. 6 is a sectional view similar to FIG. 5 illustrating the bracket therein rearranged for mounting on a bed rail larger than the bed rail illustrated in FIG. 5.

FIGS. 5 and 6 disclose another embodiment of the bracket generally designated by numeral 100 which is adapted for use with a bed rail 16 in which the flanges 36 and 40 are 1½ inches in width or a bed rail 16' in which the flanges 36' and 40' are 2 inches in width, thereby enabling the single bracket structure to be utilized with two standard size bed rails. The bracket 100 includes a vertically elongated strap 102 having a lateral upper end 104 in perpendicular relation thereto and terminating in a downturned flange 106. The vertical strap 102 is secured to the stile 24 by a wood screw 108. The vertical strap 102 is provided with an offset portion 110 which is relatively shallow and terminates in a vertically extending portion 112 parallel to the vertical strap 102 but spaced slightly from the stile 24 and provided with an internally threaded aperture 114 therein. The lower end of the vertical portion 112 terminates in an outwardly extending flange 116 and, a downwardly vertically extending portion 118 having an internally threaded aperture 120 therein. The downwardly extending portion 118 terminates in an inwardly extending flange 122 which in turn terminates in a downwardly extending attaching portion 124 parallel to and in the same plane as the vertical strap 102 which is secured to the stile 24 by a wood screw 108. Attached to the vertical strap 102 is an anchoring strap 126 of substantially the same construction as the anchoring strap 50 in FIG. 2 which includes an inturned hook-shaped end 128 engaging the edge of the flange 40 and the opposite end is provided with a downturned end portion 130 having an aperture which receives a bolt 132 that is screw threaded into the threaded aperture 114, thus securing the two parts of the bracket 100 to the bed rail 16 with the juncture between the vertical flange 36 and the horizontal flange 40 of the bed rail being such that it rests on the offset portion 110 as illustrated in FIG. 5. This arrangement enables the strap 102 to be secured in place on the stile 24 by use of the wood screws 108 and the anchoring strap 126 loosely attached thereto by the bolt 132. After the hook-shaped end defined by the members 104 and 106 is engaged with the flange 36, the hook-shaped end 128 is engaged with the free edge of the flange 40 and the bolt 132 tightened, thereby securing the ladder to the bed rail 16.

FIG. 6 illustrates the same structure oriented in a different arrangement in which the bolt 132 and the securing strap 126 have been lowered so that the bolt 132 is now inserted through the threaded aperture 120 in the flange 118. In this arrangement, the wider flanges 36' and 40' of the bed rail 16' are engaged by the hook-shaped upper end of the strap 102 and the surface of the flange 36' engages the surface of the vertical portion 112 and the surface of the flange 40' is engaged by the surface 116 and the attaching strap 126. Thus, flanges 36 and 40 having a width of 1½ inches may be engaged by the bracket 100 or by rearranging the attaching strap and bolt 132, bed rail flanges 36' and 40' of 2 inches in width can be engaged by the bracket, thus reducing the necessity of inventorying two different size brackets.

Each embodiment of the bracket prevents accidental disengagement of the ladder from the bed rail, prevents longitudinal sliding of the ladder on the bed rail, prevents the ladder from tilting outward while being climbed, prevents twisting or torqueing of the bed rail about its longitudinal axis and reduces the strain on the bed rail and the legs or posts. This provides a safe attachment for the ladder and the positive connection between the ladder and bed rail provides a feeling of security for children using the ladder, since the ladder remains immobile when a child climbs the ladder to the upper bed. The bracket structure also prolongs the life expectancy of the bunk bed and ladder by reducing the stresses on both the bed and ladder. The brackets also eliminate a safety hazard which exists in conventionally suspended ladders for bunk beds.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a bunk bed assembly including a leg supported upper bed having a generally horizontally disposed bed rail and a ladder extending vertically alongside the bunk bed assembly to enable access to the upper bed, that improvement comprising bracket means supporting the ladder from the bed rail, said bracket means including means engaging the upper edge of the bed rail and means engaging the lower edge of the bed rail to prevent accidental disengagement of the ladder from the bed rail and to prevent longitudinal sliding movement of the ladder in relation to the bed rail, said bracket means including a separate bracket structure mounted on each stile of the ladder, said means engaging the upper edge of the bed rail including a terminal end of a bracket strap overlying the top edge and engaging the inner surface of a vertical flange of a right angled bed rail, the means engaging the bottom edge of the bed rail including a strap having a hook-shaped end engaging the inner edge of the horizontal flange of the bed rail and an opposite end connected with the stile of the ladder to prevent relative vertical movement between the ladder and rail and prevent relative twisting between the ladder and rail, said strap engaged with the vertical flange of the rail extends to a point below the rail with the strap engaging the lower flange of the rail being secured to the lower portion of the vertical strap, said vertical strap including two offset portions disposed at different vertical levels for engaging the bottom flange of two different size bed rails, said offset portions having fastener receiving means thereon at two laterally spaced positions to enable the horizontal strap to engage with two different size bed rails.

2. The structure as defined in claim 1 wherein each fastener receiving means includes an internally threaded aperture, and a screw threaded bolt engaged with the threaded aperture to enable preassembly of the bracket means with the stiles and assembly of the ladder onto the bed rail by tightening the bolts.

3. The structure as defined in claim 2 wherein said internally threaded apertures are also vertically spaced to enable the vertical strap to engage with bed rails having different vertical flange dimensions.

4. In combination with a bunk bed having a generally horizontally disposed bed rail and a ladder extending vertically alongside the bed rail, the ladder including a pair of vertical stiles and the bed rail including a vertical flange having a free upper edge and a horizontal flange extending inwardly from the lower portion of the vertical flange and terminating in a free inner edge, that improvement comprising bracket means supporting the ladder from the bed rail, said bracket means including a bracket attached to each stile of the ladder, each bracket including a vertically extending member fixedly mounted on the stile and having a portion extending inwardly over the upper edge of the rail and downwardly in overlying relation to a portion of the inner surface of the vertical flange of the rail, and an independent retaining member terminating in a hook-like end engaged with the inner edge of the horizontal flange of the rail, the other end portion of the retaining member including fastening means associated therewith to move the hook-like end toward the stile for clampingly securing the bracket to the bed rail to prevent accidental disengagement of the ladder from the bed rail, longitudinal sliding movement of the ladder on the bed rail, outward tilting of the ladder when climbing and twisting or torqueing of the bed rail.

5. The combination of claim 4 wherein said vertical member includes a vertically elongated strap having an inwardly and downwardly extending upper end hooked over the upper edge of the vertical flange of the bed rail, said hook-like end on the retaining member cooperating with the upper end of the strap to securely mount the ladder on the rail.

6. The combination of claim 5 wherein said strap extends below the bed rail and includes an inwardly offset portion, said fastening means associated with the retaining member including screw threaded fastening means connecting the retaining member to the offset portion for moving the hook-like end of the retaining member into clamping relation to the inner edge of the horizontal flange of the bed rail.

7. The combination of claim 6 wherein said offset portion of the strap underlies and supports the outer portion of the horizontal flange of the bed rail, said retaining member closely underlying the horizontal flange of the bed rail and terminating in a downturned outer end disposed in opposed relation to the offset portion of the strap, said screw threaded fastening means extending through and interconnecting the downturned end of the retaining member and the offset portion of the strap.

8. The combination of claim 7 wherein said strap includes a second offset portion at a lower level and of a greater lateral extent to provide an alternative point of connecting the retaining member to the strap to enable the bracket to be securely mounted on two different sizes of bed rail.

9. The combination of claim 5 wherein said retaining member underlies the horizontal flange of the bed rail and terminates in a downturned end in opposed relation to the stile, said fastening means including a screw extending through the downturned end of the retaining member into the stile.

10. The combination of claim 4 wherein said vertical member includes a vertically elongated strap attached to the stile above the bed rail and including an inwardly offset lower end extending inwardly over the upper edge and downwardly along the inner surface of the vertical flange of the bed rail, said retaining member underlying the horizontal flange of the bed rail and terminates in a downturned end in opposed relation to the stile, said fastening means including a screw extending through the downturned end of the retaining member into the stile.

* * * * *